US005417158A

United States Patent [19]

Parsio

[11] Patent Number: 5,417,158

[45] Date of Patent: May 23, 1995

[54] RECIPROCATOR SLEEVE FOR USE IN A PRINTING PRESS MACHINE HAVING AN ENVELOPE FEEDER

[75] Inventor: John R. Parsio, Galena, Ohio

[73] Assignee: Multi-Plastics, Inc., Westerville, Ohio

[21] Appl. No.: 161,248

[22] Filed: Dec. 3, 1993

[51] Int. Cl.[6] ..... B65H 9/08; B65H 5/00

[52] U.S. Cl. ..... 101/232; 271/2; 271/5; 271/14; 271/99

[58] Field of Search ..... 101/232; 400/626, 627; 271/2, 5, 11, 12, 14, 90, 96, 99, 184, 274; 226/97

[56] References Cited

U.S. PATENT DOCUMENTS

| | | | |
|---|---|---|---|
| 3,586,312 | 6/1971 | Sammons | 271/2 |
| 3,796,426 | 3/1974 | Schilpf | 271/100 |
| 3,892,400 | 7/1975 | Harrison | 271/9 |
| 3,944,211 | 3/1976 | Rasmussen et al. | 271/8.1 |
| 4,082,262 | 4/1978 | Konars et al. | 271/149 |
| 4,118,025 | 10/1978 | Konars et al. | 271/273 |
| 4,184,670 | 1/1980 | Rosendahl | 271/99 |
| 4,239,117 | 12/1980 | Konars et al. | 209/553 |
| 4,269,405 | 5/1981 | Mitzel | 271/99 |
| 4,299,325 | 11/1981 | Quinton et al. | 209/553 |
| 4,324,394 | 4/1982 | Mitzel | 271/5 |
| 4,355,796 | 10/1982 | Day | 271/99 |
| 4,375,190 | 3/1983 | Quinci et al. | 101/177 |
| 4,431,323 | 2/1984 | Kulow | 400/625 |
| 4,986,522 | 1/1991 | Paulson | 271/2 |
| 5,072,922 | 12/1991 | Paulson | 271/2 |
| 5,088,717 | 2/1992 | Hamanaka et al. | 271/99 |
| 5,115,918 | 5/1992 | DeWitt et al. | 271/184 |
| 5,261,996 | 11/1993 | Rossini | 226/97 |
| 5,265,868 | 11/1993 | Bowser et al. | 271/274 |

OTHER PUBLICATIONS

Dual Feed Super Jet, Halm Industries Product Literature.

Super Jet Press Refractor, Specs-Halm Industries.

Jet Press Perfector Specs-Halm Industries.

Hostalen® Gur Product Guide, Hoescht Celanese Corp.

1900® "UHMW Polyethylene", Modern Plastics Encycl. pp. 60–61, vol. 68, No. 11 (Oct. 91).

Stein, H. L., "Ultrahigh Molecular Weight Polyethylenes (UHMWPE)" Eng., Materials Handbook.

*Primary Examiner*—Eugene H. Eickholt

*Attorney, Agent, or Firm*—Mueller and Smith

[57] ABSTRACT

A reciprocator sleeve for use in a printing machine having an envelope feeder is disclosed which enables the feeder to convey windowed envelopes from a stack and into a pair of pinch rollers without marking the windows of the envelopes. The sleeve is adapted for use with the feeder reciprocator upon which the bottommost envelope in the stack is retained for its conveyance therefrom and into a pair of pinch rollers. The reciprocator has a cylindrical head which is reciprocatingly rotated about its longitudinal axis to provide a generally arcuate feed and return stroke between the stack and the pinch rollers, and a shaft extending from an end of the head to a drive assembly. The head is in fluid communication with a vacuum source and has at least one vacuum port for applying a negative pressure differential to the front face of the bottommost envelope in the stack to retain that envelope for its conveyance on the feed stroke from the envelope stack and into the pinch rollers. The sleeve is formed of a tubular member which receives the reciprocator head and has an outer surface with at least one fenestration therethrough in registration with a corresponding vacuum port of the head. The tubular member is formed of a polymeric material effective to allow the windowed opening of each envelope in the stack to travel unmarked over its outer surface as each envelope is drawn from the reciprocator head on the return stroke thereof.

18 Claims, 3 Drawing Sheets

10

16
2
12
24
14
22
2
18
20

12

96
100
98
32
33
81
35
34
66a
28a
78
70
66b
30a
96a
26a
86
54
56
3
3
36
26b
42
68b
30b
96b
72
80
28b
68a
62
44
64

RECIPROCATOR SLEEVE FOR USE IN A PRINTING PRESS MACHINE HAVING AN ENVELOPE FEEDER

BACKGROUND OF THE INVENTION

The present invention relates broadly to a reciprocator sleeve for use in an offset printing press machine having an envelope feeder which enables the feeder to convey windowed envelopes from an envelope stack into a pair of pinch rollers without scratching or otherwise marking the windows of the envelopes.

The ubiquitous "windowed" envelope is familiar to all as the harbinger of both bills and checks alike. Windowed envelopes, such as the standard No. 10 billing envelope, are constructed, as are conventional envelopes, from a folded sheet of paperstock, but differ in having a window generally configured as a 4.5 inch (11.43 cm) by 1.125 inch (2.86 cm) rectangular opening located adjacent the lower left corner of the front face of the envelope. The window is provided so that an address printed on a corresponding portion of the bill, check, or the like contained in the envelope may be revealed without having to show the remainder of the correspondence. Accordingly, an underlayment of clear, or at least translucent, plastic film is adhered to the inside of the envelope both to seal the window and to allow for the viewing of the selected portion of the correspondence contained in the envelope. Typically, such films are formed of a clear, matte, or rubber-modified polystyrene material having a film thickness of from about 0.00115 inch (0.02921 ram) to about 0.002 inch (0.0508 ram).

The use of a windowed envelope to reveal an address printed on its contents advantageously obviates the need for the sender to reprint the address of the intended recipient on the face of the envelope. Indeed, by preprinting a return address or logo on the face of a windowed envelope, a sender may most economically effect a mass mailing of correspondences such as bills, payments, advertising materials, or the like to customers or creditors. In this regard, offset printing or "letter press" machines equipped to automatically feed a stack of envelopes to an associated offset printing press head are commonly employed by those in the printing industry. Typical of these printing machines are the JET PRESS TM machines manufactured by Halm Industries Co., Inc., 180 Glen Head Road, Glen Head, N.Y. 11545, and marketed under the model numbers JP-TWOD-P, JP-TWOD-6D, JP-TWOD-P-D, JP-FWOD, and JP-FWOD-W. The operation of such machines is described in detail by Harrison, U.S. Pat. Nos. 3,892,400; Schilpf, 3,796,426; and Quinci et al., 4,375,190, the disclosures of which are expressly incorporated herein by reference.

Generally, the envelope printing machines common in the art employ an envelope feeder to automatically deliver envelopes to the printing press head. Such feeders generally involve an arrangement of front, lateral, and back guides for positioning an envelope stack above a reciprocator. The reciprocator is formed as having a cylindrical head for reciprocating rotation about its longitudinal axis to provide a feed and a return stroke which describe generally arcuate loci between the envelope stack and a pair of pinch rollers leading to a feed or conveyor belt disposed beneath the reciprocator for transport of the envelopes to the printing press head. From one end of the cylindrical reciprocator head, an elongate shaft is provided to extend to a drive assembly for reciprocatingly rotating the head about its longitudinal axis. The other end of the reciprocator head is joined in fluid communication with a vacuum source for applying a constant negative pressure differential to the front face of the bottommost envelope in the stack through a plurality of axially-aligned vacuum port openings formed into the head. The constant negative pressure differential applied to the front face of the bottommost envelope in the stack through the generally rectangular vacuum ports retains that envelope on the head for its conveyance along the generally arcuate locus of the feed stroke from the envelope stack and into the pinch rollers. The pinch rollers are rotationally driven to effect a drawing of the envelope from the reciprocator head in an angular direction generally opposite that of the return stroke of the head.

Heretofore, the use of such envelope printing press machines to preprint return addresses onto windowed envelopes has been plagued with one nagging problem, to wit, that of the printing process impressing scratches or other markings into the polymeric film underlayment of the window. Indeed, apart from detracting from the aesthetics of the envelope, the generally vertical scratches or other lines scored by the printing machine across the widthwise extent of the window have been known to interfere with the scanners employed by the U.S. Postal Service to read the bar codes which may be printed below the address. Such bar codes encrypt the address in a machine-readable series of vertical lines, and allow the envelope to be automatically dispatched to the proper location for delivery by a postal carrier. As the automatic sorting of mail represents a cost savings to the Postal Service, bar-coded envelopes may be mailed at a reduced postage rate mid, understandably, are especially attractive to business and the like which generate a significant amount of outgoing mail. The scratches or other lines cut into the envelope windows by the above-described printing press machines common in the industry, however, may cause the postal scanners to misread the bar code. The misreading may result in the envelope being delivered to the wrong address, or may unnecessarily delay delivery. Where billings are concerned, such delays are especially costly as representing a loss of revenue.

Not unexpectedly, it has been discovered that the scratches and other marks developed across the widthwise extent of the envelope windows by the previously described printing press are caused by the rotating action of the reciprocator head. Although the vacuum ports of the reciprocator head are oriented to contact the font face of the bottommost envelope in the envelope stack on a paperstock portion thereof, the ports are drawn across the widthwise extent of the window as the envelope is drawn from the head by the pinch rollers. Unfortunately, the constantly-applied vacuum and the drawing of the envelope from the head in an angular direction generally opposite that of the return stroke of the head only serve to accentuate the scoring of the window. Although felt pads and cloth tapes have been applied to the reciprocator head in attempts to alleviate the problem, these solutions have not met with success as interfering either with the development of a vacuum seal between the reciprocator head and the envelope, or in lacking the structural integrity to withstand the rigors of operation in a machine which may print up to about 40,000 envelopes per hour. The wearing or other structural failure of the tapes and pads heretofore known in the art has been seen as a maintenance problem as necessitating the stopping of production while replacement tapes or pads are installed. Understandably, such stoppages, often as frequent as daily or weekly, are not favored by the printing industry and often lead to a printer dispensing completely with such pads or tapes until a customer returns a printed envelope batch as unacceptable. Thus, it is apparent that another solution would be well-received by both the envelope printing industry and its customers.

BROAD STATEMENT OF THE INVENTION

The present invention is addressed to a sleeve for use in an offset printing press machine having an envelope feeder driven by a vacuum reciprocator. The sleeve is constructed of a tubular member configured to receive the cylindrical head portion of the reciprocator therewithin and having at least one fenestration therethrough for registration with a corresponding vacuum port of the reciprocator head portion. In providing for the formation of the sleeve from a select polymeric material, the present invention, when used in conjunction with the reciprocator, advantageously allows the windowed opening of each envelope in the stack to travel unmarked over the outer surface of the sleeve as each envelope is drawn from the reciprocator head portion on its return stroke.

It is, therefore, a feature of the present invention to provide a sleeve adapted for use in a printing machine having an envelope feeder driven by a reciprocator. The sleeve is adapted for use in conjunction with the reciprocator upon which the bottommost envelope in the stack is retained for its conveyance therefrom to a pair of pinch rollers. The reciprocator has a cylindrical head which is reciprocatingly rotated about its longitudinal axis to provide a generally arcuate feed and return stroke between the stack and the pinch rollers, and a shaft extending from an end of the head to a drive assembly. The head is in fluid communication with a vacuum source and has at least one vacuum port for applying a negative pressure differential to the front face of the bottommost envelope in the stack to retain that envelope for its conveyance on the feed stroke from the envelope stack and into the pinch rollers. The sleeve is formed of a tubular member which is configured to receive the reciprocator head and has an outer surface with at least one fenestration therethrough for registration with a corresponding vacuum port of the head. The tubular member is formed of a polymeric material effective to allow the windowed opening of each envelope in the stack to travel unmarked thereover its outer surface as each is drawn from the reciprocator head on the return stroke thereof.

It is also a feature of the invention to provide a reciprocator assembly for a printing press machine having a printing press fed by an envelope feeder holding an envelope stack. A reciprocator is provided as having a cylindrical head portion which is reciprocatingly rotatable about its longitudinal axis to provide a feed stroke and a return stroke describing generally arcuate loci between the envelope stack and a pair of pinch rollers. The cylindrical head portion of the reciprocator is provided to be fluid communicable with a vacuum source and has at least one vacuum port for applying a negative pressure differential to the front face of the bottommost envelope in the stack. The envelope is retained on the head portion of the reciprocator for its conveyance along the generally arcuate locus of the feed stroke from the envelope stack to the pinch rollers. The feed rollers effect a drawing of the envelope from the head portion of the reciprocator in an angular direction generally opposite that of its return stroke. An elongate shaft portion is provided to extend from an end of the head portion of the reciprocator and is couplable to a drive assembly for reciprocatingly rotating the head portion. A sleeve is provided as a generally tubular member receiving the head portion of the reciprocator therewithin and having an outer surface with at least one fenestration therethrough in registration with a corresponding vacuum port of the reciprocator head portion. The tubular member is formed of a polymeric material effective to allow the windowed opening of each envelope in the stack to travel unmarked thereover its outer surface as each envelope is drawn from the reciprocator head portion on the return stroke thereof.

It is also a feature of the invention to provide in a printing press machine having a printing press fed by an envelope feeder holding an envelope stack which is driven by a reciprocator, a method for conveying envelopes from the envelope stack to a pair of pinch rollers. The method involves providing a sleeve formed of a generally tubular member receiving the cylindrical head portion of the reciprocator therewithin. The tubular member is provided as having an outer surface with at least one fenestration therethrough which is in registration with a corresponding vacuum port of the reciprocator head portion. The tubular member also is provided as being formed of a polymeric material effective to allow the windowed opening of each envelope in the stack to travel unmarked thereover its outer surface as each envelope is drawn from the reciprocator head by the pinch rollers. To convey the envelopes from the stack to the pinch rollers, the bottommost envelope in the stack is retained on the fenestration of the sleeve, and the cylindrical reciprocator head portion is rotated about is longitudinal axis to provide a feed stroke describing a generally arcuate locus between the stack and the pinch rollers. The envelope then is drawn by the pinch rollers from the reciprocator head portion over the outer surface of the sleeve. Lastly, to return the fenestration of the sleeve into contact with the front face of the next envelope in the envelope stack, the reciprocator head portion is oppositely rotated about its longitudinal axis to provide a return stroke describing a generally arcuate locus between the pinch rollers and the stack.

The present invention, accordingly, comprises the apparatus and method possessing the construction, combination of elements, and arrangement of parts and steps which are exemplified in the detailed disclosure to follow. An advantage of the invention includes the cost-effective provision of a durable sleeve which, when used in a reciprocator-driven envelope feeder of a printing press machine, facilitates the delivery of windowed envelopes from the feeder stack to the print head without scoring the polymeric film covering the windows of the envelopes or interfering with the development of a vacuum seal between the reciprocator the envelope. A further advantage is the ability to provide a durable reciprocator sleeve whose service life may be extended further by its rotation about the head portion of the reciprocator without the removal of the reciprocator from the feeder. A further advantage is the provision of a replaceable and relatively inexpensive sleeve which saves the relatively more costly reciprocator head from wear and thereby extends its service life. These and other advantages and objects of the present invention will be readily apparent, in part, based upon the detailed disclosure which follows.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
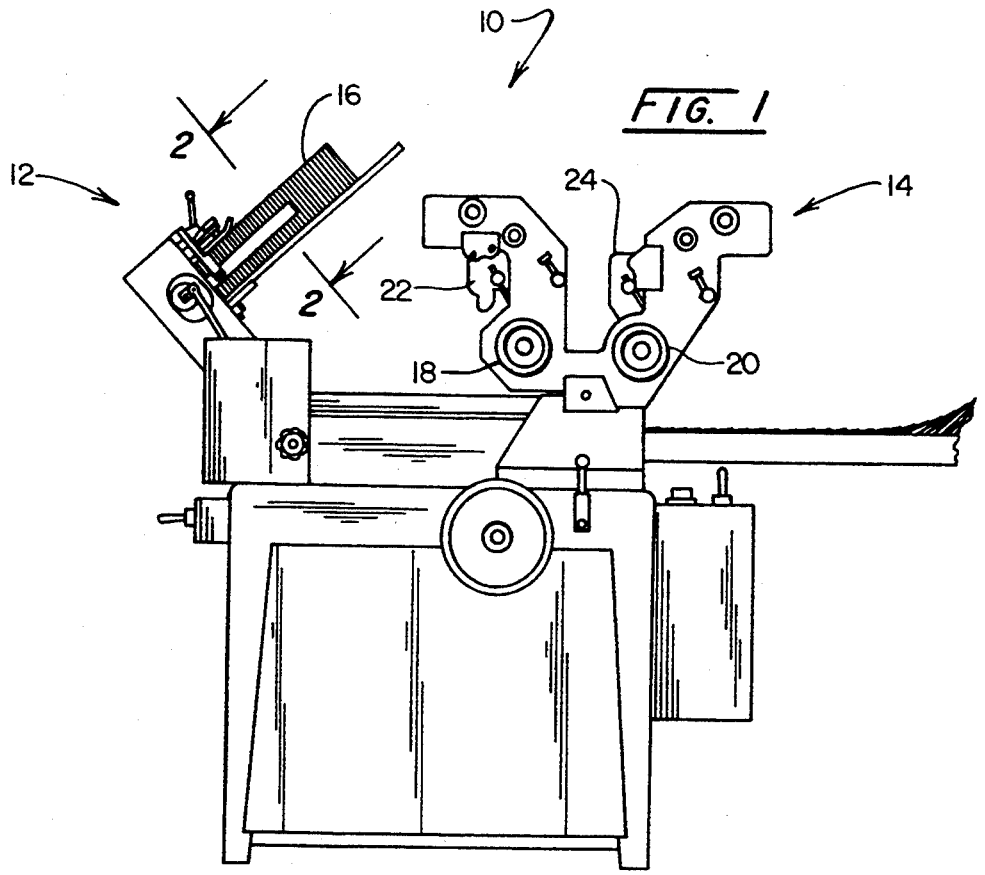
FIG. 1 shows a side elevational view of an offset printing press machine having an envelope feeder with a reciprocator and two pairs of pinch rollers for the automatic delivery of windowed envelopes from a stack thereof to a printing head.

Referring to FIG. 1, an offset printing press machine of the "letter press" variety is shown generally at 10 to comprise an envelope feeder, shown generally at 12, and a printing press head, shown generally at 14. In general operation, feeder 12 automatically delivers windowed envelopes from an envelope stack, 16, to print head 14 for the printing of return address, logos, or the like on the front face of each of the envelopes in stack 16. For illustrative purposes, print head 14 is shown to be of the two-color variety having a first and a second plate cylinder, 18 and 20, each having an offset printing plate (not shown) with one or two positive images per plate. For the transferring of their images to a blanket cylinder (not shown), each of the printing plates on plate cylinders 18 and 20 receives a particular color ink from an associated inking assembly, 22 and 24. The blanket cylinder, generally covered in cowhide or the like, receives an inked mirror image from plate cylinders 18 and 20 for transference to the front faces of the envelopes in stack 16. With each of plate cylinders 18 and 20 having two images per plate, two envelopes may be printed per each revolution of the blanket cylinder, and throughputs of up to about 40,000 envelopes per hour may be achieved. With four images per plate, the throughput may be proportionately increased up to about 80,000 envelopes per hour.

Figure 2:
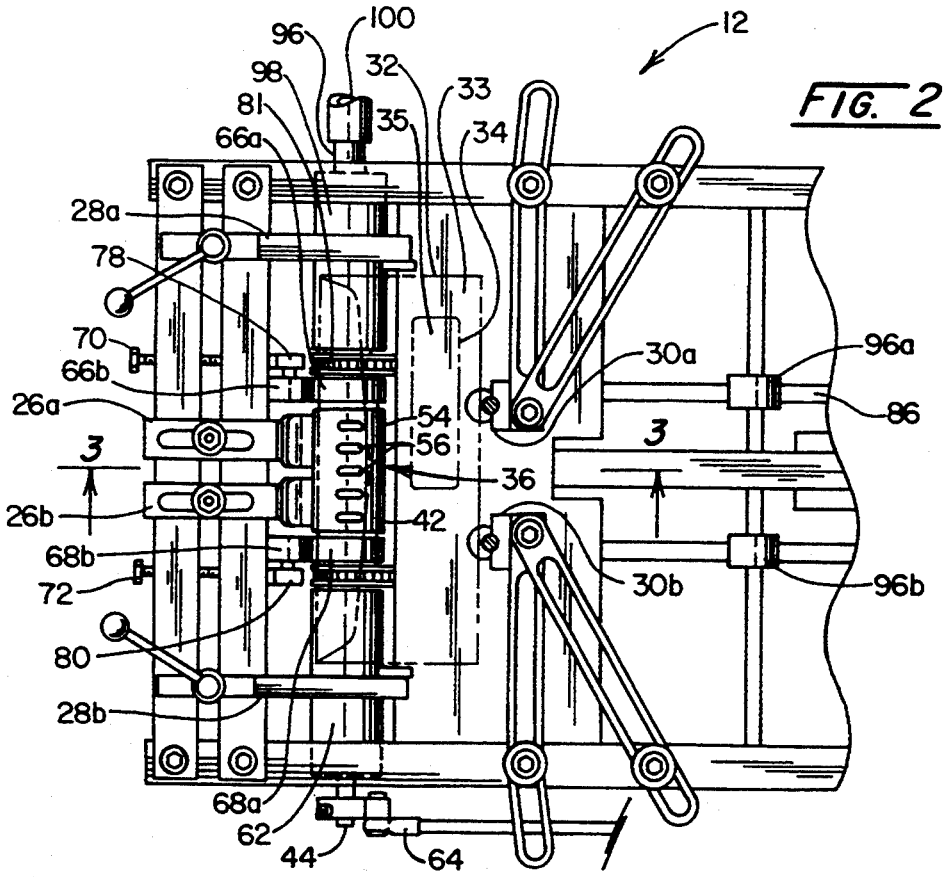
FIG. 2 is a cross-sectional view of the envelope feeder of the printing press machine of FIG. 1 taken through line 2—2 of FIG. 1.
Figure 4:
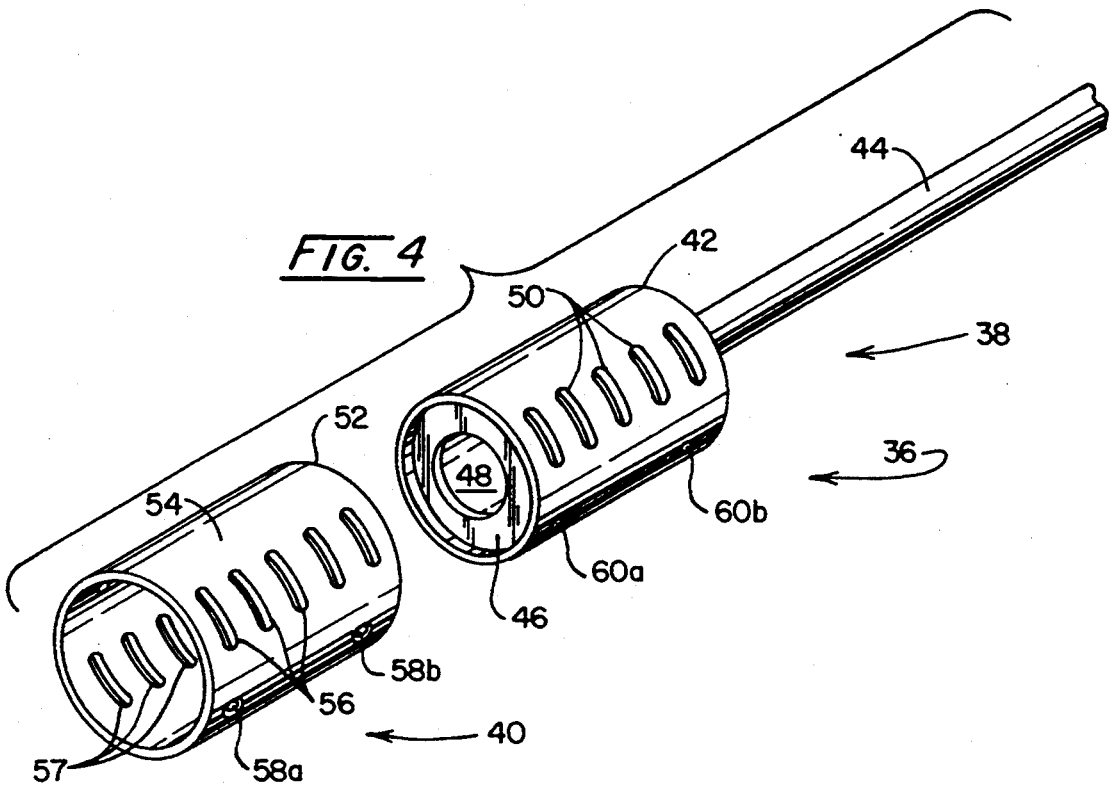
FIG. 4 is an exploded perspective view of the reciprocator of the envelope feeder of FIG. 1 showing its associated sleeve in accordance with the precepts of the present invention.

Turning to FIG. 2, feeder 12 is shown in enhanced detail. Adjustable front guides, 26*a* and 26*b*, lateral guides, 28*a* and 28*b*, and back guides, 30*a* and 30*b*, are provided to locate the bottommost envelope of stack 16, which is shown in phantom at 32, generally above a reciprocator assembly, shown at 36. Envelope 32 is shown as having a front surface, 33, with a windowed opening, 34, underlaid with a polymeric film, 35. Polymeric film 35 generally is formed of a clear, matte, or rubber-modified polystyrene material having a film thickness of from about 0.00115 inch (0.02921 mm) to about 0.002 inch (0.0508 ram), such films being marketed by MultiPlastics, Inc., 7770 North Central Drive, Westerville, Ohio 43081, under the trade designations EWF® 1000, EWF® 2001 LDLJ, and EWF® 2002. Looking to FIG. 4, reciprocator assembly 36 may be seen to comprise a reciprocator, shown generally at 38, and a sleeve, shown generally at 40, which is provided in accordance with the precepts of the present invention. Reciprocator 38 may be provided as an original equipment part or as specially manufactured for use in conjunction with sleeve 40.

As is known in the art, reciprocator 38 has a cylindrical head portion, 42, which may be formed of aluminum or the like, and an elongate shaft, 44, which may be formed of a mild or stainless steel or the like. An annular insert, 46, which also may be formed of a mild or stainless steel or the like, is provided such that head 42 may be coupled to a vacuum source for the evacuation of its interior cavity, represented at 48. For providing fluid communication with cavity 48, a plurality of vacuum ports, represented at 50, are formed into head 42. Sleeve 40 is formed in accordance with the present invention as a generally tubular member, 52, configured to receive head 42 therewithin. Through the outer surface, 54, of tubular member 52 are formed a plurality of fenestrations, shown generally at 56, for registration with a corresponding vacuum port 50 of head 42. Preferably, as is shown at 57, a second plurality of fenestrations corresponding to vacuum ports 50 are formed through outer surface 54. Fenestrations 56 and 57 and are disposed in outer surface 54 to be alternatingly movable into registration with vacuum ports 50 via the rotation of sleeve 40 about reciprocator head 42. By providing a second set of fenestrations in tubular member 52, the service life of sleeve 40 may be extended in that fenestrations 57 may be alternatingly rotated into registration with vacuum ports 50 upon the wearing of the portion of outer surface 54 surrounding fenestrations 56.

Optionally, as is shown at 58*a* and 58*b*, tubular member 52 is formed with a plurality of apertures configured to receive therethrough a mechanical fastener (not shown) such a countersinking machine screw or the like. Apertures 58 are disposed about tubular member 52 for registration with corresponding axial holes, 60*a* and 60*b*, of reciprocator head 42. Axial holes 60 are configured for threaded engagement with the mechanical fasteners received through sleeve apertures 58 for removably fastening tubular member 52 to reciprocator head 42. By removably fastening annular member 52 to head 42 in the manner described, sleeve 40 may be rotated about head 42, to move, for example, fenestrations 57 into registration with vacuum ports 50 without having to disassemble feeder 12 to remove reciprocator 38 therefrom.

Returning to FIG. 2, it may be seen that shaft 44 of reciprocator 38 is provided to extend through an elongate roller, 62, into mechanical connection with a rocker arm assembly, 64. For reciprocatingly rotating shaft 44 to effect a corresponding rotation of reciprocator head 42 about its longitudinal axis, rocker arm 64 extends to a cam (not shown) which, in turn, is driven by a drive motor (not shown). Rocker arm 64 and its associated cam and drive motor thus comprise a drive assembly effecting, through shaft 44, the reciprocating rotation of reciprocator head 42.

Figure 3:
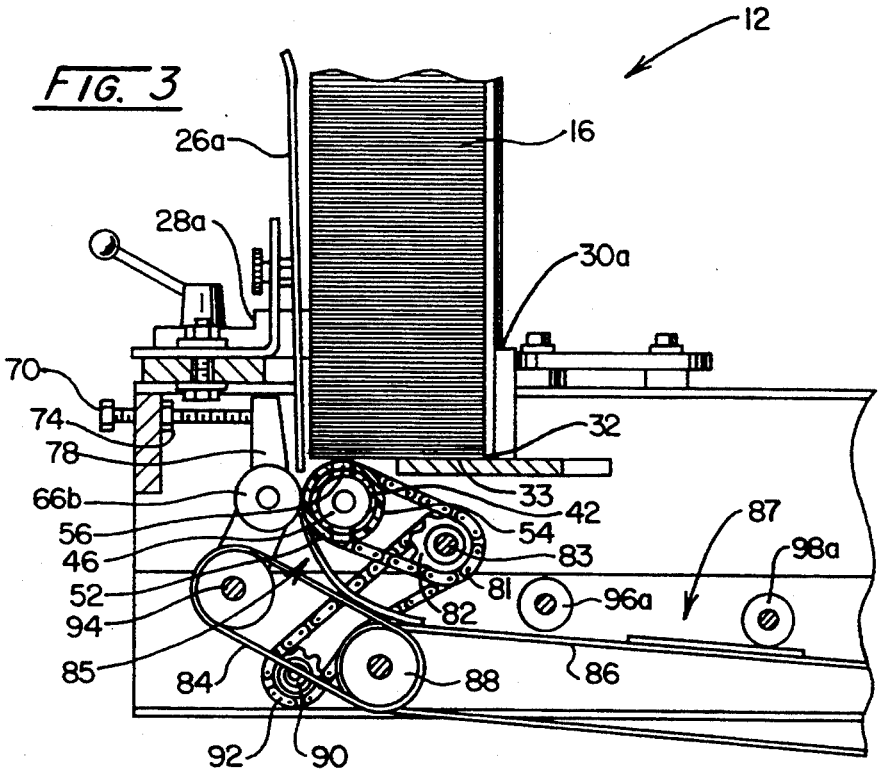
FIG. 3 is a cross-sectional view of the envelope feeder of the printing press machine of FIG. 1 taken through line 3—3 of FIG. 2.

Looking additionally to FIG. 3, it may be seen that the reciprocating rotation of head 42 provides a feed and return stroke, each of which describes a generally arcuate locus between stack 16 and two pinch roller pairs, 66 and 68 (FIG. 2). Locking screws 70 and 72, each having an associated locking nut, 74 and 76 (not shown), are provided to adjustably bias, respectively, pinch rollers **66*b* and 68*b* against corresponding pinch rollers 66*a* and 68*a*. As may be seen in FIG. 3 with respect to pinch roller pair 66, each of locking screws 70 and 72 are adjustably movably into engagement with an associated lever arm, 78 and 80, controlling the movement of pinch rollers 66*b* and 68*b* into corresponding rollers 66*a* and 68*a***.

Considering pinch roller pair 66, with pinch roller pair 68 being understood to be driven analogously, a drive sprocket, 82, and an associated drive shaft, 83, and drive chain, 81, are provided to effect a rotation of pinch roller **66*a* which will be understood to be in an angular direction generally opposite that of reciprocator head 42 on its return stroke from roller pairs 66 and 68 to stack 16. Accordingly, upon the delivery of envelope 32 into pinch roller pairs 66 and 68 on the feed stroke of reciprocator head 42, envelope 32, as is represented at 85, will be drawn therefrom and over outer surface 52 of sleeve 40 in an angular direction generally opposite that of head 42 on its return stroke to feeder 16. Once drawn from head 42, envelope 32, as is represent at 87, will be delivered by the rotational motion of pinch roller pairs 66 and 68 onto a series of feed belts, 84 and 86, leading to print head 14 (FIG. 1 ). Feed belts 84 and 86 may be commonly driven with a drive roller, 88, and an associated idler sprocket, 90, and drive chain, 92, with power being supplied by drive shaft 83. Associated with drive belt 84 is an idler roller, 94, and with drive belt 86 are roller pairs 96 and 98**.

Returning to FIG. 2, head 42 of reciprocator 38 is shown as coupled to a line, 96, which extends through an elongate roller, 98, to a vacuum line, 100. Vacuum line 100 extends to a vacuum source (not shown) which may be a vacuum pump or the like for the evacuation of cavity 48 (FIG. 4) of reciprocator head 42. Through cavity 48 and, accordingly reciprocator head vacuum ports 50 and sleeve fenestrations 56 which are in fluid communication therewith, a negative pressure differential is constantly applied to front surface 33 of envelope 32 for its retention on fenestrations 56 and outer surface 54 of sleeve 40. As may be seen in FIG. 3, the vacuum retention of envelope 32 on sleeve 40 allows envelope 32 to be conveyed along the generally arcuate locus of the feed stroke of reciprocator head 42 from stack 16 and into pinch roller pairs 66 and 68. Upon the drawing of envelope 32 from sleeve 40 over outer surface 54 thereof, fenestrations 56 are returned to stack 16 on the return stroke of reciprocator head 42 into retentive contact with the front face of the next envelope in stack 16.

Figure 5:
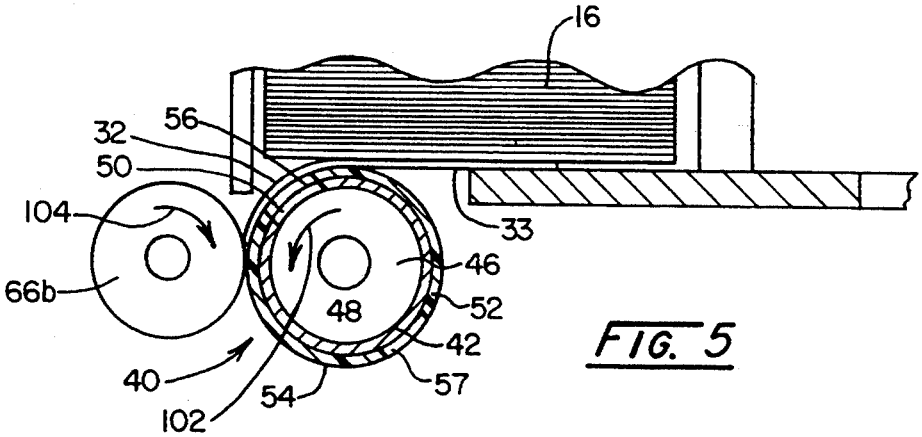
FIG. 5 is an enlarged cross-sectional view generally in accordance with FIG. 3 showing in enhanced detail the conveyance of the bottommost envelope in the stack into the pinch rollers on the feed stroke of the reciprocator.
Figure 6:
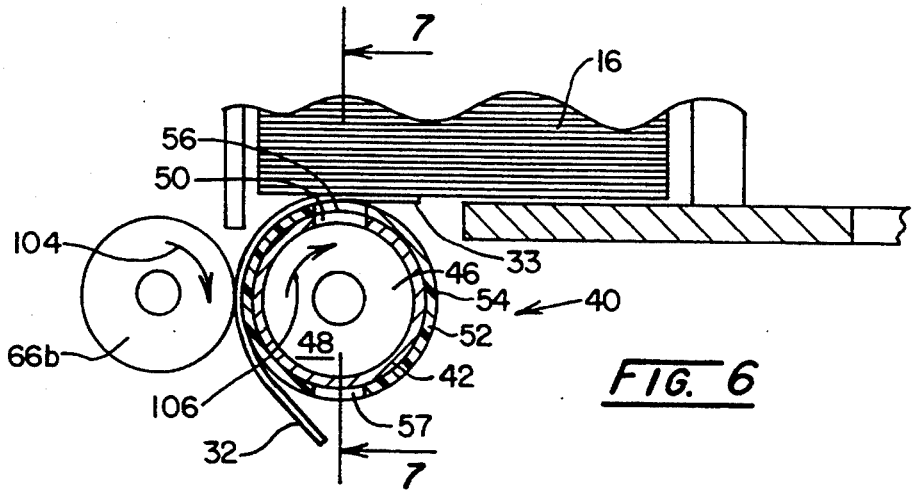
FIG. 6 is an enlarged cross-sectional view generally in accordance with FIG. 3 showing the drawing of the envelope of FIG. 5 from the reciprocator on the return stroke thereof.
Figure 7:
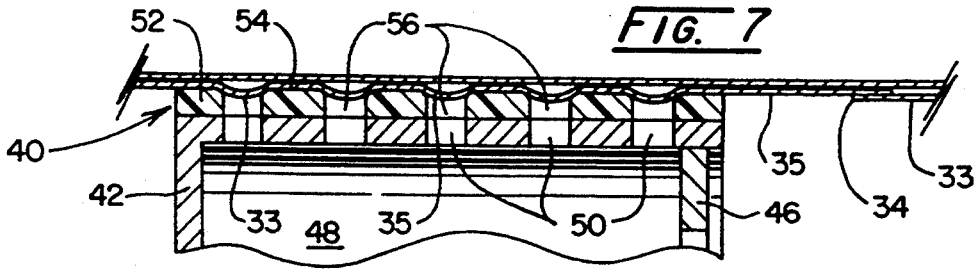
FIG. 7 is an enlarged cross-sectional view taken through line 7—7 of FIG. 6 showing in enhanced detail the interface between the window of the envelope of FIGS. 5 and 6 and the reciprocator during the return stroke thereof.

Looking next to FIGS. 5, 6, and 7, the drawing of envelope 32 from sleeve 40 and reciprocator head 42 is considered in greater detail to illustrate the advantages of the present invention. As seen in FIG. 5, envelope 32 is delivered into pinch roller pair 66 via the rotation, as is indicated by arrow 102, of reciprocator head 42 on its feed stroke. Continuing to FIG. 6, envelope 32 is drawn from sleeve 40 and reciprocator head 42 via the rotation of pinch roller **66*b* in the clockwise angular direction represented by arrow 104 which, as is shown by arrow 106, is generally opposite that of the counterclockwise rotation of reciprocator head 42 on its return stroke. However, as may be seen through momentary reference to FIG. 2, although stack 16 may be positioned with respect to reciprocator head 42 such that envelope 32 is received thereon on a paperstock stock portion of its front face 33, it will be appreciated that the rotation of head 42 on its return stroke effects a passage of vacuum ports 50 across the widthwise extent of window 34. Heretofore, such passage directly over the outer aluminum surface of reciprocator head 42 has resulted in the scoring of a series of generally vertical scratches or other markings into the polymeric film underlayment, 35, of envelope window 34**.

Looking to FIG. 7, it may be seen appreciated that the deleterious scoring of film 35 of window 34 is remedied via the interposition of sleeve 40 between reciprocator head 42 and film 35. In this regard, tubular member 52 of sleeve 40 is provided to be formed of a polymeric material having a coefficient of friction, hardness, impact strength, and abrasion resistance effective to allow the window 34 of envelope 32 to travel unmarked over its outer surface 54. Indeed, it has been discovered that notwithstanding that film 35 is drawn into fenestrations 56 of sleeve 40 by the vacuum constantly applied to cavity 48 of reciprocator head 42, film 35 nevertheless passes over the outer surface 54 of sleeve 40 unmarked. Absent the provision of sleeve 40 over reciprocator head 42, however, the drawing of film 35 into vacuum ports 50, in conjunction with the drawing of envelope 32 from reciprocator head 42 in an angular direction generally opposite that of head 42 on its return stroke, results in an objectionable scoring of film 35. Moreover, it has been observed experimentally that the severity of the scoring of film 35 increases directly with the number of envelopes placed in stack 16 and., accordingly the external normal force or pressure exerted on envelope 32. No such affect, however, has been observed when sleeve 40 is utilized.

Figure 8:
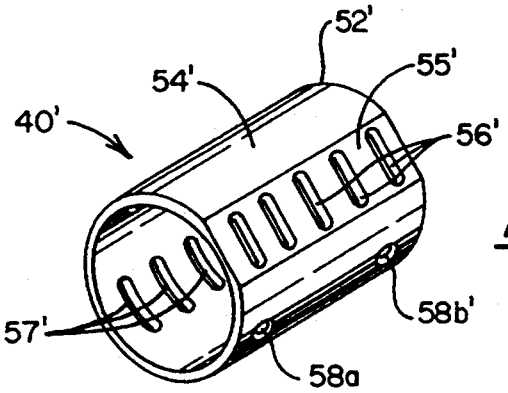
FIG. 8 is another embodiment of a reciprocator sleeve in accordance with the precepts of the invention.

Looking next to FIG. 8, an alternative embodiment of the inventive reciprocator sleeve is shown generally at 40' as having an outer surface 54' having a generally planar portion, 55', of a given axial width and which extends along the entire longitudinal length of annular member 52'. Fenestrations 56', upon which the outer surface 33 of envelope 32 is received, are provided to be disposed within planar portion 55'. Planar portion 55', in presenting a generally planar surface upon which to receive the front face 33 of envelope 32, thereby assists in the maintaining of a vacuum seal between the outer surface 54' of annular member 52' and the front face 33 of envelope 32. Thus, sleeve 40' may be seen as being adapted for use with heavier bond envelopes whose weight necessitates the development of a stronger vacuum pressure for their retention on reciprocator head 42. In accordance with the present invention, it will be appreciated that a second planar portion 55' (not shown) may be provided within which may be disposed fenestrations 57'.

Considering the materials of construction for sleeve 40, the selection thereof is seen as critical to the operability of the present invention. In this regard, it has been discovered empirically that, for the polystyrene films prevalent in the industry, an ultrahigh molecular weight polyethylene (UHMWPE) is preferred. Sleeves formed of other polymers such as polyamides, polytetrafluoroethylene, and other polyethylenes were tested but without success as marring the surface of the envelope window, having a surface too slippery to retain the envelope thereon with the available vacuum pressure, and/or exhibiting unacceptably excessive wear.

Broadly, the preferred UHMWPE of the present invention is characterized as a high density, linear polyethylene having a weight average molecular weight of from about 3 to 6 million. UHMWPE resins are produced by the Hoechst Celanese Co., Houston Tex., under the trade designations Hostalen ® GUR 412, 413 and 415, and by Himont, USA, Inc., Wilmington, Del., under, for example, the trade designation 1900® UHMW. Inasmuch as the resin exhibits no appreciable melt flow, it is usually supplied to fabricators in the form of a fine powder for processing by compression molding or ram extruding. For the application contemplated by the present invention, extruded tubes, such as those marketed by the Dayton Plastics Co. of Columbus, Ohio, are preferred as readily machinable into the desired configuration. Additional information on UHMWPE is provided in the following references, the disclosures of which are expressly incorporated herein by reference: Stein, H. L., "Ultrahigh Molecular Weight Polyethylenes (UHMWPE)," Engineered Materials Handbook, *Volume 2: Engineering Plastics,* pp. 167–171, ASM International, Materials Park, Ohio (1992); and Miller, R. C., "UHMW Polyethylene," Modern Plastics Encyclopedia, pp. 60–61, Vol. 68, No. 11 (Mid-October 1991).

Although it is not yet understood precisely why the preferred UHMWPE material performs so well in the particular application contemplated by the present invention, it is speculated that the explanation does involve the unique combination of physical properties exhibited by UHMWPE resins which somehow interact with those of the polystyrene film material of the envelope window. In this regard, UHMWPE is known to possess high abrasion resistance, high impact strength, low frictional coefficients, and a self-lubricity which, evidently, provide a durable but slippery surface upon which the front face of the envelope may be retained, and yet over which the window of the envelope may slide without being scratched or otherwise marked or scored. The high impact and abrasion resistance of the polymer also is seen as providing a surface which is itself resistant to scratches or other imperfections which would give rise to surface asperities tending to mar the surface of the envelope window. Undoubtedly, the hardness of UHMWPE, Rockwell R50, ASTM D785, *Modern Plastics Encyclopedia* , p. 409, Vol. 68, No. 11 (Mid-October 1991), relative to that of polystyrene, Rockwell M85, ASTM D785, EWF 1000 Data Sheet, MultiPlastics, Inc., Westerville, Ohio, also is seen as contributing to the unexpectedly good results. The other physical properties of UHMWPE seen as relevant to the precepts of the present invention are tabularized hereinafter, together with selected comparisons to other common materials of construction.

TABLE 1

Coefficients of Friction of UHMWPE and Unpolished Mild Steel[1]

| Material | Static[2] | Kinetic[2] |
|---|---|---|
| Mild Steel on Mild Steel | 0.30–0.40 | 0.25–0.35 |
| Mild Steel on UHMWPE | 0.15–0.20 | 0.12–0.20 |
| UHMWPE on UHMWPE | 0.20–0.30 | 0.20–0.30 |

[1]Hostalen ® GUR Product Guide, Hoechst Celanese Corporation, League City TX.
[2]ASTM Test Method D 1894.

TABLE 2

Comparison of Dynamic Coefficients of Friction on Polished Steel[1]

| Material | Dry | Water | Oil |
|---|---|---|---|
| UHMWPE | 0.10–0.22 | 0.05–0.10 | 0.05–0.08 |
| Polyamide | 0.15–0.40 | 0.14–0.19 | 0.02–0.11 |
| Nylon 6/6 | 0.15–0.40 | 0.14–0.19 | 0.02–0.11 |
| Polyamide/ molybdenum disulfide | 0.12–0.20 | 0.10–0.12 | 0.08–0.10 |
| Polytetrafluoro-ethylene | 0.04–0.25 | 0.04–0.08 | 0.04–0.05 |
| Acetal copolymer | 0.15–0.35 | 0.10–0.20 | 0.05–0.10 |

[1]Stein, H. L., "Ultrahigh Molecular Weight Polyethylenes (UHMWPE)," Engineered Materials Handbook, Volume 2: Engineering Plastics, p. 168, ASM International, Materials Park, Ohio (1992).

TABLE 3

Comparative Abrasion Resistance of UHMWPE and Selected Materials[1]

| Material | Relative Abrasion[2] |
|---|---|
| UHMWPE | 100 |
| Cast polyamide | 150 |
| Stainless Steel | 160 |
| Nylon 6/6 | 160 |
| Polytetrafluoroethylene | 530 |
| Polypropylene | 660 |
| Acetal Copolymer | 700 |
| Polyvinylchloride | 920 |
| Polymethylmethacrylate | 1800 |
| Phenolic | 2500 |
| Beechwood | 2700 |
| Epoxy | 3400 |

[1]Stein, H. L., "Ultrahigh Molecular Weight Polyethylenes (UHMWPE)," Engineered Materials Handbook, Volume 2: Engineering Plastics, p. 168, ASM International, Materials Park, Ohio (1992).
[2]Volume loss relative to UHMWPE as measured by a "sand/water slurry test" in which a test sample is rotated at high velocity in an aluminum oxide water slurry for two hours. The higher the figure, the greater the loss to abrasion.

TABLE 4

Impact Strength of UHMWPE[1]

| Temperature | Double-notched Izod Impact Strength,[2] kJ/m (ft-lb$_f$/in) |
|---|---|
| 23° C. (73° F.) | 1.6 (30) |
| −40° C. (−450° F.) | 1.1 (21) |

[1]Stein, H. L., "Ultrahigh Molecular Weight Polyethylenes (UHMWPE)," Engineered Materials Handbook, Volume 2: Engineering Plastics, p. 169, ASM International, Materials Park, Ohio (1992).
[2]ASTM Test Method D 256(a) with samples modified as having two 15° V-notches to a depth of 5 mm (0.20 in) on opposite sides.

The following example is illustrative of the precepts of the present invention, but should not be construed in a limiting sense.

EXAMPLE

In accordance with the present invention, a reciprocator sleeve was constructed for use in a Halm JP-TWOD offset printing press machine located at the Columbus Envelope Co., Inc., of Columbus Ohio. The printing press machine was equipped with an envelope feeder having a reciprocator with a head formed of an aluminum material. The sleeve was constructed from an extruded tube formed of an UHMWPE having a weight average molecular weight of about 4 to 6 million. Such tube was obtained from the Dayton Plastics Co. of Columbus, Ohio, and had a nominal 1¾inch (4.445 cm) inner diameter and a nominal wall thickness of ¼ inch (6.35 ram). The tube was cut into a 2.5 inch (6.35 cm) length and was machined to obtain a wall thickness of about 0.125 inch (3.175 mm) and a 2 inch (5.08 cm) inner diameter. A series of five (5) 0.625 inch (15.87 mm) by 0.1875 (4.76 mm) fenestrations were milled through the sleeve for registration with corresponding vacuum ports of the reciprocator head. The sleeve was attached to the head of the reciprocator using a press-fit and four (4) flathead 8–32 machine screws. The reciprocator then was reinstalled in the printing press machine.

Production runs of standard No. 10 billing envelopes having windows underlaid with clear polystyrene film were made, and the results obtained were compared to identical envelopes which had been fed through the envelope feeder prior to the installation of the UHMWPE sleeve on the reciprocator head. The results showed that the envelopes printed using the sleeved reciprocator had windows which were essentially unmarked, while those printed using the reciprocator unsleeved had windows which were marred by a series of scratches extending across their widthwise extents. The experimental results thus confirm the utility and advantages of the present invention.

It is anticipated that certain changes may be made in the apparatus and method described hereinbefore without departing from the scope of the invention herein involved. In this regard, it will be appreciated that the composition of the envelope window film may affect which material of construction is preferred for forming the reciprocator sleeve of the present invention. As aforementioned, for the polystyrene films prevalent in the industry, an ultrahigh molecular weight polyethylene is preferred. However, for other window film materials, such as polyesters or polypropylenes, a more conventional high-density polyethylene having a weight average molecular weight of from about 50,000 to less than about 3 million may be suitable, as may be other polymers such as polytetrafluoroethylene, nylons, polyurethanes, polyesters, polypropylenes, polystyrenes, and the like. The precepts of the present invention therefore extend beyond forming the sleeve from the preferred polymeric material. Suffice it to say that, following the teachings of the present disclosure, one of ordinary skill in the art would be capable of selecting an operable material of construction for any given window film. Accordingly, it is intended that all matter contained in the foregoing description of the invention or shown in the accompanying drawings shall be interpreted as illustrative rather than in a limiting sense.

What is claimed:

1. For a printing press machine having a printing press fed by an envelope feeder holding an envelope stack, each envelope in the stack having a windowed opening on a front face thereof which is undefined with a polymeric film, the feeder having a reciprocator which comprises a cylindrical head portion reciprocatingly rotated about its longitudinal axis to provide a feed stroke and a return stroke describing generally arcuate loci between the envelope stack and at least a pair of pinch rollers, the head portion being in fluid communication with a vacuum source and having at least one vacuum port for applying a negative pressure differential to the front face of the bottommost envelope in the stack to retain that envelope for its conveyance along the generally arcuate locus of the feed stroke from the envelope stack and into the pinch rollers effecting a drawing of the envelope from the head portion in an angular direction generally opposite that of the return stroke of the head portion, and an elongate shaft portion extending from an end of the head portion to a drive assembly for reciprocatingly rotating the head portion, a sleeve comprising a generally tubular member configured to receive the reciprocator head portion therewithin and having an outer surface with at least one fenestration therethrough for registration with a corresponding vacuum port of the reciprocator head portion, said tubular member being formed of a polymeric material having a coefficient of static friction on dry, unpolished mild steel of from about 0.15 to about 0.20 and effective to allow the windowed opening of each envelope in the stack to travel unmarked over the outer surface of said tubular member as each envelope is drawn from the reciprocator head portion on the return stroke thereof.

2. The sleeve of claim 1 wherein said tubular member is formed of a high-density polyethylene having a weight average molecular weight of from about 50,000 to about 6 million.

3. The sleeve of claim 2 wherein said high-density polyethylene is an ultrahigh molecular weight polyethylene having a weight average molecular weight of from about 3 million to about 6 million.

4. The sleeve of claim 1 wherein the outer surface of said tubular member has a generally planar portion of a given axial width and longitudinal length within which said fenestration is disposed.

5. The sleeve of claim 1 wherein said tubular member has at least one other fenestration therethrough corresponding to the vacuum port of the reciprocator head portion, the fenestrations being disposed in said tubular member to be movable into alternating registration with the vacuum port by the rotation of said sleeve about the head portion.

6. For a printing press machine having a printing press fed by an envelope feeder holding an envelope stack, each envelope in the stack having a windowed opening on a front face thereof which is underlaid with a polymeric film, a reciprocator assembly for conveying envelopes from the stack and into at least a pair of pinch rollers comprising:

a reciprocator having a cylindrical head portion reciprocatingly rotatable about its longitudinal axis to provide a feed stroke and a return stroke describing generally arcuate loci between the envelope stack and the pinch rollers, said head portion being fluid communicable with a vacuum source and having at least one vacuum port for applying a negative pressure differential to the front face of the bottommost envelope in the stack to retain that envelope for its conveyance along the generally arcuate locus of the feed stroke from the envelope stack and into the pinch rollers effecting a drawing of the envelope from said head portion in an angular direction generally opposite that of the return stroke of said head portion, and an elongate shaft portion extending from an end of said head portion which is couplable to a drive assembly for reciprocatingly rotating said head portion; and a sleeve comprising a generally tubular member receiving said head portion therewithin and having an outer surface with at least one fenestration therethrough in registration with a corresponding vacuum port of said head portion, said tubular member being formed of a polymeric material having a coefficient of static friction on dry, unpolished mild steel of from about 0.15 to about 0.20 and effective to allow the windowed opening of each envelope in the stack to travel unmarked over the outer surface of said tubular member as each envelope is drawn from said head portion of said reciprocator on the return stroke thereof.

7. The reciprocator assembly of claim 6 wherein said polymeric material is a high-density polyethylene having a weight average molecular weight of from about 50,000 to about 6 million.

8. The reciprocator assembly of claim 7 wherein said high-density polyethylene is an ultrahigh molecular weight polyethylene having a weight average molecular weight of from about 3 million to about 6 million.

9. The reciprocator assembly of claim 6 wherein the outer surface of said tubular member of said sleeve has a generally planar portion of a given axial width and longitudinal length within which said fenestration is disposed.

10. The reciprocator assembly of claim 6 wherein said tubular member has at least one other fenestration therethrough corresponding to said vacuum port of said head portion of said reciprocator, the fenestrations being disposed in said tubular member to be movable into alternating registration with said vacuum port by the rotation of said sleeve about said head portion.

11. In a printing press machine having a printing press fed by an envelope feeder holding an envelope stack, each envelope in the stack having a windowed opening on a front face thereof which is underlaid with a polymeric film, the feeder having a reciprocator which comprises s cylindrical head portion reciprocatingly rotated about its longitudinal axis to provide a fed stroke and a return stroke describing generally arcuate loci between the envelope stack and at least a pair of pinch rollers, the head portion being in fluid communication with a vacuum source and having at least one vacuum port for applying a negative pressure differential to the front face of the bottommost envelope in the stack to retain that envelope stack for its conveyance along the generally arcuate locus of the feed stroke from the envelope stack and into the pinch rollers effecting a drawing of the envelope from the head portion in an angular direction generally opposite that of the return stroke of the head portion, and an elongate shaft portion extending from an end of the head portion to a drive assembly for reciprocatingly rotating the head portion, a method of conveying envelopes from the envelope stack to the pinch rollers comprising the steps of:

providing a sleeve comprising a generally tubular member receiving the reciprocator head portion therewithin and having an outer surface with at least one fenestration therethrough in registration with a corresponding vacuum port of the reciprocator head portion, said tubular member being formed of a polymeric material having a coefficient of static friction on dry, unpolished mild steel of from about 0.15 to about 0.20 and effective to allow the windowed opening of each envelope in the stack to travel unmarked over the outer surface of said tubular member as each envelope is drawn from the reciprocator head portion on the return stroke thereof;

retaining the bottommost envelope in the stack on the fenestration of said sleeve;

rotating the reciprocator head portion about the arcuate locus of the feed stroke to convey the retained envelope from the stack and into the pinch rollers;

drawing the envelope from said reciprocator head portion over the outer surface of said sleeve with the pinch rollers; and rotating the reciprocator head portion about the arcuate locus of the return stroke to return the fenestration of said sleeve into contact with the front face of the next envelope in the envelope stack.

12. The method of claim 11 wherein said tubular member is formed of a high-density polyethylene having a weight average molecular weight of from about 50,000 to about 6 million.

13. The method of claim 12 wherein said high-density polyethylene is an ultrahigh molecular weight polyethylene having a weight average molecular weight of from about 3 million to about 6 million.

14. The method of claim 11 wherein the outer surface of said tubular member has a generally planar portion of a given axial width and longitudinal length within which said fenestration is disposed.

15. The method of claim 11 wherein said tubular member has at least one other fenestration therethrough corresponding to the vacuum port of the reciprocator head portion, the fenestrations being disposed in said tubular member to be movable into alternating registration with the vacuum port by the rotation of said sleeve about the head portion.

16. For a printing press machine having a printing press fed by an envelope feeder holding an envelope stack, each envelope in the stack having a windowed opening on a front face thereof which is underlaid with a polymeric film, the feeder having a reciprocator which comprises a cylindrical head portion reciprocatingly rotated about its longitudinal axis to provide a feed stroke and a return stroke describing generally arcuate loci between the envelope stack and at least a pair of pinch rollers, the head portion being in fluid communication with a vacuum source and having at least one vacuum port for applying a negative pressure differential to the front face of the bottommost envelope in the stack to retain that envelope for its conveyance along the generally arcuate locus of the feed stroke from the envelope stack and into the pinch rollers effecting a drawing of the envelope from the head portion in an angular direction generally opposite that of the return stroke of the head portion, and an elongate shaft portion extending from an end of the head portion to a drive assembly for reciprocatingly rotating the head portion, a sleeve comprising a generally tubular member configured to receive the reciprocator head portion therewithin and having an outer surface with at least one fenestration therethrough for registration with a corresponding vacuum port of the reciprocator head portion, said tubular member being formed of a polymeric material effective to allow the windowed opening of each envelope in the stack to travel unmarked over the outer surface of said tubular member as each envelope is drawn from the reciprocator head portion on the return stroke thereof, and having at least one aperture therethrough for registration with a corresponding axial hole of the reciprocator head portion, said aperture being configured to receive a mechanical fastener therethrough for removably fastening said sleeve to the head portion.

17. For a printing press machine having a printing press fed by an envelope feeder holding an envelope stack, each envelope in the stack having a windowed opening on a front face thereof which is underlaid with a polymeric film, a reciprocator assembly for conveying envelopes from the stack and into at least a pair of pinch rollers comprising:

a reciprocator having a cylindrical head portion reciprocatingly rotatable about its longitudinal axis to provide a feed stroke and a return stroke describing generally arcuate loci between the envelope stack and the pinch rollers, said head portion being fluid communicable with a vacuum source and having at least one vacuum port for applying a negative pressure differential to the front face of the bottommost envelope in the stack to retain that envelope for its conveyance along the generally arcuate locus of the feed stroke from the envelope stack and into the pinch rollers effecting a drawing of the envelope from said head portion in an angular direction generally opposite that of the return stroke of said head portion, and an elongate shaft portion extending from an end of said head portion which is couplable to a drive assembly for reciprocatingly rotating said head portion;

a sleeve comprising a generally tubular member receiving said head portion therewithin and having an outer surface with at least one fenestration therethrough in registration with a corresponding vacuum port of said head portion, said tubular member being formed of a polymeric material effective to allow the windowed opening of each envelope in the stack to travel unmarked over the outer surface of said tubular member as each envelope is drawn from said head portion of said reciprocator on the return stroke thereof; and at least one threaded fastener for removably affixing said sleeve to said head portion of said reciprocator, said head portion having at least one axial hole configured for threadable engagement with said fastener and said sleeve having at least one aperture therethrough corresponding to and in registration with said axial hole of said head portion, said fastener extending through said aperture of said sleeve into threaded engagement with said hole of said head portion.

18. In a printing press machine having a printing press fed by an envelope feeder holding an envelope stack, each envelope in the stack having a windowed opening on a front face thereof which is underlaid with a polymeric film, the feeder having a reciprocator which comprises a cylindrical head portion reciprocatingly rotated about its longitudinal axis to provide a feed stroke and a return stroke describing generally arcuate loci between the envelope stack and at least a pair of pinch rollers, the head portion being in fluid communication with a vacuum source and having at least one vacuum port for applying a negative pressure differential to the front face of the bottommost envelope in the stack to retain that envelope for its conveyance along the generally arcuate locus of the feed stroke from the envelope stack and into the pinch rollers effecting a drawing of the envelope from the head portion in an angular direction generally opposite that of the return stroke of the head portion, and an elongate shaft portion extending from an end of the head portion to a drive assembly for reciprocatingly rotating the head portion, a method of conveying envelopes from the envelope stack to the pinch rollers comprising the steps of:

providing a sleeve removably affixed to said reciprocator head portion with a threaded fastener, said sleeve comprising a generally tubular member receiving the reciprocator head portion therewithin and having an outer surface with at least one fenestration therethrough in registration with a corresponding vacuum port of the reciprocator head portion, said tubular member being formed of a polymeric material effective to allow the windowed opening of each envelope in the stack to travel unmarked over the outer surface of said tubular member as each envelope is drawn from the reciprocator head portion on the return stroke thereof, and having at least one aperture therethrough for registration with a corresponding axial hole of the reciprocator head portion configured for threadable engagement with the fastener, the fastener extending through said aperture of said sleeve into threaded engagement with the hole of the reciprocator head portion;

retaining the bottommost envelope in the stack on the fenestration of said sleeve;

rotating the reciprocator head portion about the arcuate locus of the feed stroke to convey the retained envelope from the stack and into the pinch rollers;

drawing the envelope from said reciprocator head portion over the outer surface of said sleeve with the pinch rollers; and rotating the reciprocator head portion about the arcuate locus of the return stroke to return the fenestration of said sleeve into contact with the front face of the next envelope in the envelope stack.

* * * * *